US006030274A

United States Patent [19]

Kaplan

[11] Patent Number: 6,030,274

[45] **Date of Patent: *Feb. 29, 2000**

[54] TOY AND TRANSPARENT PACKAGING ASSEMBLY SUITABLE FOR MAILING

[76] Inventor: Joan C. Kaplan, 8 Princeton St., Closter, N.J. 07624

[ * ] Notice: This patent issued on a continued prosecution application filed under 37 CFR 1.53(d), and is subject to the twenty year patent term provisions of 35 U.S.C. 154(a)(2).

[21] Appl. No.: 08/989,566

[22] Filed: Dec. 12, 1997

[51] Int. Cl.[7] ..... A63H 3/02; B65D 85/16; B42D 15/00

[52] U.S. Cl. ..... 446/369; 446/73; 446/76; 446/81; 206/776; 206/457; 206/459.5; 229/92.8

[58] Field of Search ..... 446/71–73, 75–76, 446/81, 147, 299, 369; 229/92.8; 206/457, 459.5, 778, 776, 782, 770, 771; 40/638, 661; 383/106; 220/665

[56] References Cited

U.S. PATENT DOCUMENTS

| | | | |
|---|---|---|---|
| 2,636,597 | 4/1953 | Hinz . | |
| 3,199,248 | 8/1965 | Suzuki | 446/299 |
| 4,108,227 | 8/1978 | Bonner | 150/15 |
| 4,213,531 | 7/1980 | Rae | 206/463 |
| 4,491,217 | 1/1985 | Weder et al. . | |
| 4,795,397 | 1/1989 | Stevens . | |
| 4,842,140 | 6/1989 | Mesnard | 206/457 |
| 4,874,340 | 10/1989 | Smallwood . | |
| 4,913,284 | 4/1990 | Versaci . | |
| 4,936,460 | 6/1990 | Meyer | 206/524.8 |
| 4,946,039 | 8/1990 | Garran | 206/575 |
| 5,005,336 | 4/1991 | Bloom | 53/401 |
| 5,133,683 | 7/1992 | Dorfman . | |
| 5,166,851 | 11/1992 | Jacobson | 360/137 |
| 5,183,429 | 2/1993 | Bitton . | |
| 5,326,300 | 7/1994 | Sonders | 446/74 |
| 5,421,761 | 6/1995 | Pitcher et al. . | |
| 5,515,563 | 5/1996 | Chao . | |
| 5,607,101 | 3/1997 | Saito | 229/71 |
| 5,641,062 | 6/1997 | Burton et al. . | |
| 5,842,900 | 12/1998 | Hodge | 446/73 |

FOREIGN PATENT DOCUMENTS

| | | | |
|---|---|---|---|
| 0 206 500 | 5/1985 | European Pat. Off. . | |
| 1531719 | 5/1967 | France . | |
| 2239814 | 1/1990 | United Kingdom | 446/147 |

*Primary Examiner*—Robert A. Hafer
*Assistant Examiner*—Laura Fossum
*Attorney, Agent, or Firm*—Salter & Michaelson

[57] ABSTRACT

A combination toy and packaging assembly which is suitable for mailing without additional packaging includes a toy, preferably a plush toy animal, having predetermined areas thereon for receiving mailing and return addresses, and for indicating proper placement of postage. The sender of the toy can write the name and address of the receiving person onto the toy. The toy can be further provided with additional areas to write messages, pockets for gift items, flaps for pictures, electronic voice chips for outputting voice or musical greetings, strings for hanging the toy as an ornament, pins for attaching the toy to clothing, etc. The plush toy animal is received within a transparent, flexible plastic casing which substantially conforms to the outer surface of the toy. The casing includes a resealable opening for inserting and removing the toy from the casing. When the toy is received within the casing, the mailing and return addresses are clearly visible through the casing so that the assembly can be properly handled by mail carriers. Postage is placed on the exterior of the casing over the predetermined area indicated on the body of the toy, after which, the toy assembly can be placed into the mail without additional packaging. Other embodiments include an assembly consisting of a card upon which the sender writes the mailing and return addresses, a miniature toy and a transparent flexible envelope.

21 Claims, 10 Drawing Sheets

TOY AND TRANSPARENT PACKAGING ASSEMBLY SUITABLE FOR MAILING

BACKGROUND AND SUMMARY OF THE INVENTION

The instant invention generally relates to children's toys, and more particularly to a toy and a transparent packaging assembly which is suitable for mailing the toy through the postal system. The toy preferably comprises a plush toy which can receive personal written information and/or messages thereon, and the packaging assembly preferably comprises a flexible transparent casing so that the written messages and/or information, such as a forwarding address, is visible through the packaging.

A wide variety of different concepts for packaging products of all types have been developed through the years. For example, in the toy industry, concerns about the protection of toys during shipping and handling, combined with the need to still be able to view the toys at the retail level have led to several different transparent packaging concepts, including cellophane wrapping as disclosed in U.S. Pat. No. 2,636,597 to Hinz, rigid glass containers for dolls as also disclosed in U.S. Pat. No. 2,636,597 to Hinz, conformable plastic packaging such as that disclosed in French Patent No. 1,531,791 to Simon, and cardboard packaging with transparent windows as currently seen in the market. Concerns regarding the space required to ship plush toys have also led to plush toys having an expandable filling and a rigid shipping container for enclosing the toys in a compacted condition, such as disclosed in European Patent Application No. 0 206 500 A1 to Sachs. In the flower industry, flexible transparent packaging concepts have also been developed for protection and display of flowers, such as corsages. The U.S. Patent to Weder et al U.S. Pat. No. 4,491,217 is representative of this type of prior art. The Weder Patent discloses a bag for displaying and protecting a corsage of fresh flowers wherein the bag is formed from a printed blank of flexible transparent plastic film. A rear wall of the packaging is printed to provide a contrasting color for the flowers. In the field of stamp collecting, a transparent packaging concept for authenticating first day issues of stamps has been known in the art. In this regard, the U.S. Patents Versaci U.S. Pat. No. 4,913,284 discloses a clear, flexible package for receiving rolls of stamps to be authenticated. The rolls of stamps are received into the clear package and sealed with a printing label. The printing label includes a stamp removed from the roll, and printed postal cancellation stamp with the date applied over the stamp to signify the authentication date.

Concepts for applying messages or other written information to toys have also been known in the art. In this regard, the U.S. Patent to Stevens U.S. Pat. No. 4,795,397 discloses a toy doll having a defined area thereon for applying a label having various information about the doll thereon. Also known in the art is the DOODLE BEAR® manufactured by Tyco Industries, Inc., which comprises a plush bear having a fabric which can be written on (DOODLE BEAR is a trademark of Tyco Industries, Inc.). Words, drawings, tattoos, etc. can be applied to the outer fabric surface of the bear with a marker, and then later washed off to provide extended play value to the toy.

Despite the wide variety of toys and packaging concepts known in the art, the prior art does not include any concepts which appear to address the need for a toy which can be provided with a message from the sender and then be placed directly into the mail system for delivery without further packaging.

In this regard, the instant invention provides a toy assembly which is suitable for mailing without additional packaging. The toy assembly comprises a toy, preferably a plush toy animal, having a body portion and predetermined areas on the body portion for receiving mailing and return addresses, and for indicating proper placement of postage. The sender of the toy can write the name and address of the receiving person directly onto the predetermined areas on the toy. The toy can be further provided with additional features including: areas to write personal messages or draw pictures; pockets for receiving gift items; flaps for hiding pictures, or gift items or additional writing areas; electronic voice chips for outputting and/or recording voice or musical greetings; strings for hanging the toy as an ornament; pins for attaching the bears to clothing; and other features common to greeting items. The plush toy animal is received within a transparent, flexible plastic casing which substantially conforms to the outer surface of the toy. The casing includes a resealable opening for inserting and removing the toy from the casing. When the toy is received within the casing, the mailing and return addresses are clearly visible through the casing in the same general positions as they would be located on an envelope so that the assembly can be properly handled by mail carriers. Postage is placed on the exterior of the casing over the predetermined area indicated on the body of the toy, after which, the toy assembly can be placed into the mail without additional packaging. Other embodiments of the concept include an assembly consisting of: a card or mailing label upon which the sender writes the forwarding and return addresses; a miniature toy, preferably a miniature plush toy animal, upon which a personal greeting and/or the names of the sender and receiver can be written; and a transparent, flexible plastic envelope with a resealable flap. The card and toy are received within the envelope for mailing. The miniature plush toy would also preferably includes a pin for the receiver to attach the toy to clothing or a string for hanging the toy as an ornament. In yet another concept, the toy assembly would include a larger primary plush toy, and a plurality of mailable envelope assemblies as described above. The sender would thereafter send the mailable toy assemblies to their friends, while the friends would also do the same, the object being to exchange and collect a plurality of the miniature toys and attach them to the larger primary plush animal for display.

Accordingly, among the objects of the instant invention are: the provision of a toy which can receive written information or a message thereon, and a packaging assembly for the toy which allows the toy to be placed directly into the mail; the provision of such a toy wherein the toy comprises a plush toy which can receive written messages on the outer surface thereof; the provision of such a toy which includes predetermined areas for receiving a mailing address, return address and postage; the provision of such a toy which includes an pocket for receiving and hiding a smaller gift element therein; the provision of such a toy which includes a flap behind which there can be hidden a surprise gift or a photograph; the provision of such a toy which includes a pin for securing the toy to a fabric; the provision of such a toy which includes means for hanging the toy as a decorative ornament; the provision of such a toy which selectively outputs an electronic audio greeting such as a musical tune or recorded message; the provision of a packaging assembly for the toy which comprises a transparent casing for receiving the toy therein; and the provision of such a packaging assembly which includes a resealable opening for receiving the toy within the packaging.

Other objects, features and advantages of the invention shall become apparent as the description thereof proceeds when considered in connection with the accompanying illustrative drawings.

DESCRIPTION OF THE DRAWINGS

In the drawings which illustrate the best modes presently contemplated for carrying out the present invention.

DESCRIPTION OF THE PREFERRED EMBODIMENT

Figure 1:
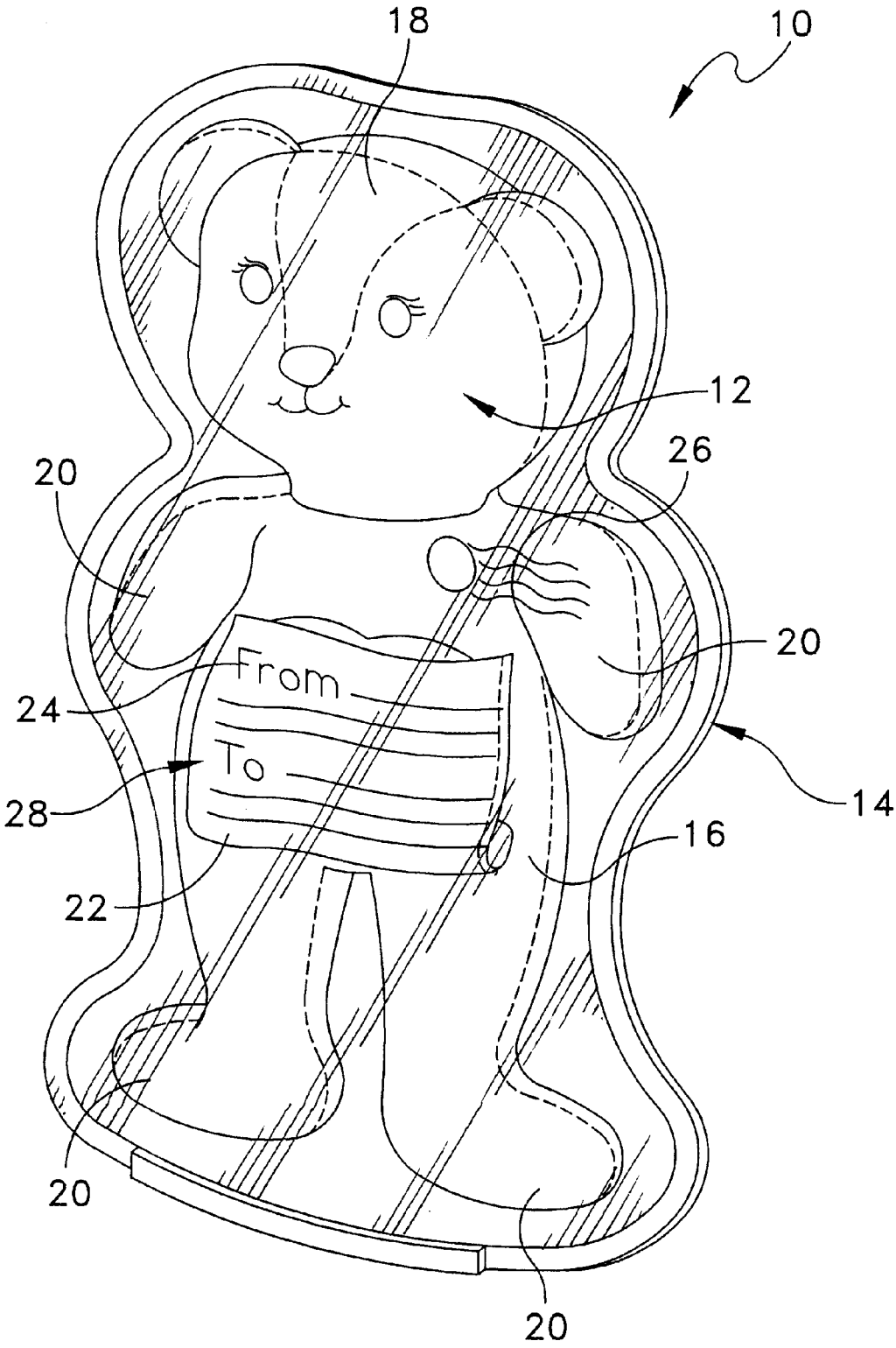
FIG. 1 is a perspective view of a plush toy bear and packaging assembly in accordance with the teachings of the instant invention.

Referring now to the drawings, the combination toy and packaging assembly of the instant invention is illustrated and generally indicated at 10 in FIG. 1. As will hereinafter be more fully described, the instant invention provides a suitable means for mailing a toy without additional packaging.

The assembly 10 comprises a toy generally indicated at 12, and a transparent flexible casing generally indicated at 14.

The toy 12 preferably comprises a plush toy animal, such as a bear, having a body portion 16, and further having a head portion 18, and limb portions 20. The toy 12 further comprises a first predetermined area 22 (shown in broken line) on the body portion 16 for receiving a mailing address, a second predetermined area 24 (shown in broken line) on the body portion 16 for receiving a return addresses, and a third predetermined area 26 (shown in broken line) on the body portion 16 for indicating proper placement of postage on the exterior casing 14. While the toy 12 is shown and described as comprising a plush toy animal, it is to be understood that the concepts as disclosed herein are equally applicable to other types of toys, such as dolls, toy cars, action figures, etc., so long as the toy is large enough to provide space for the predetermined areas 22, 24, 26 thereon.

Figure 2:
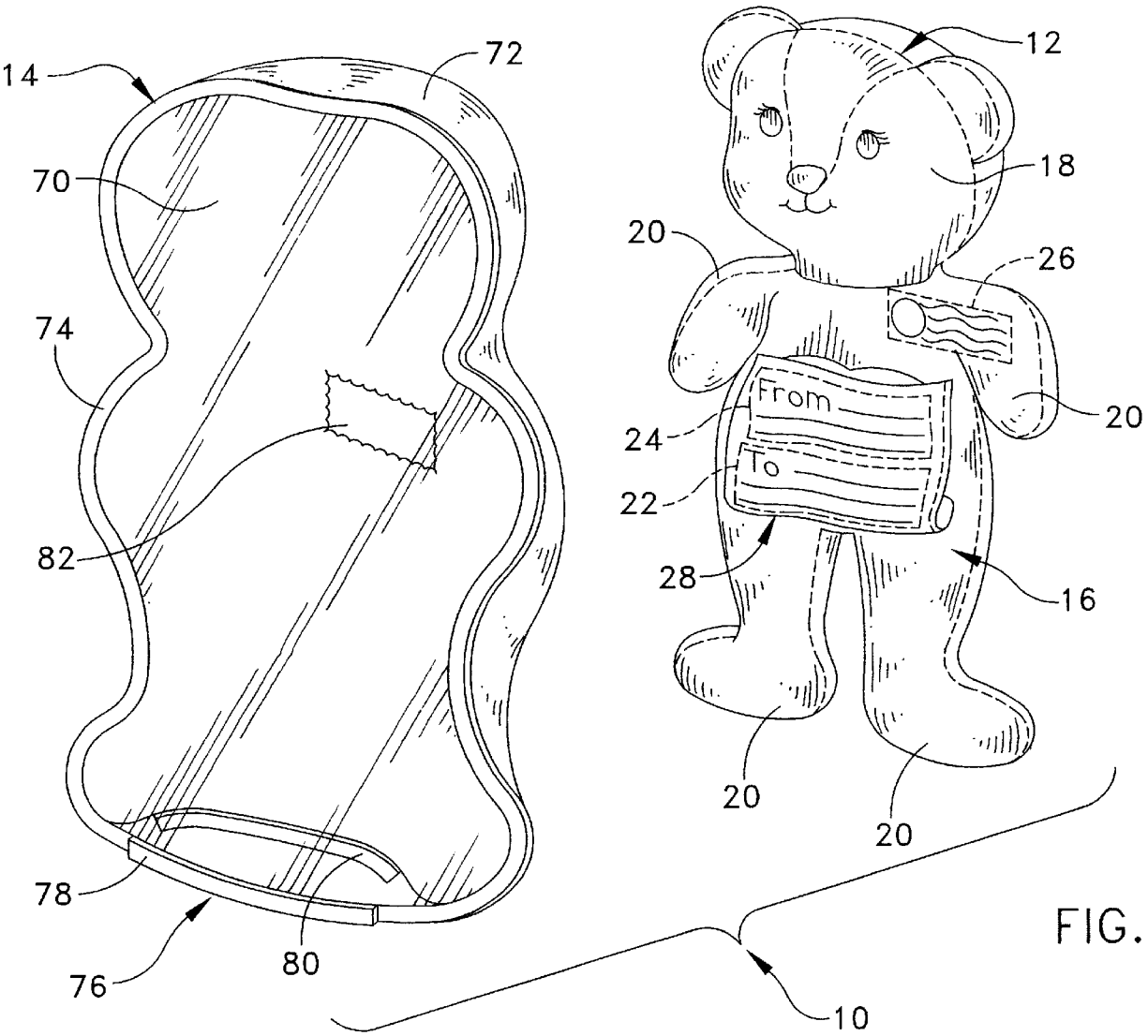
FIG. 2 is an exploded perspective view thereof.

The sender of the toy assembly 10 can write the name and address of the receiving person directly onto the predetermined address areas 22, 24 on the toy (FIG. 2). In this regard, the plush toy 12 is preferably constructed from a fabric material which can receive markings from a pen or other type of writing implement. In the alternative, the toy 12 could be provided with adhesive labels (not shown) upon which the addresses could be written and then applied to the predetermined areas 22, 24 on the toy 12.

Figure 3:
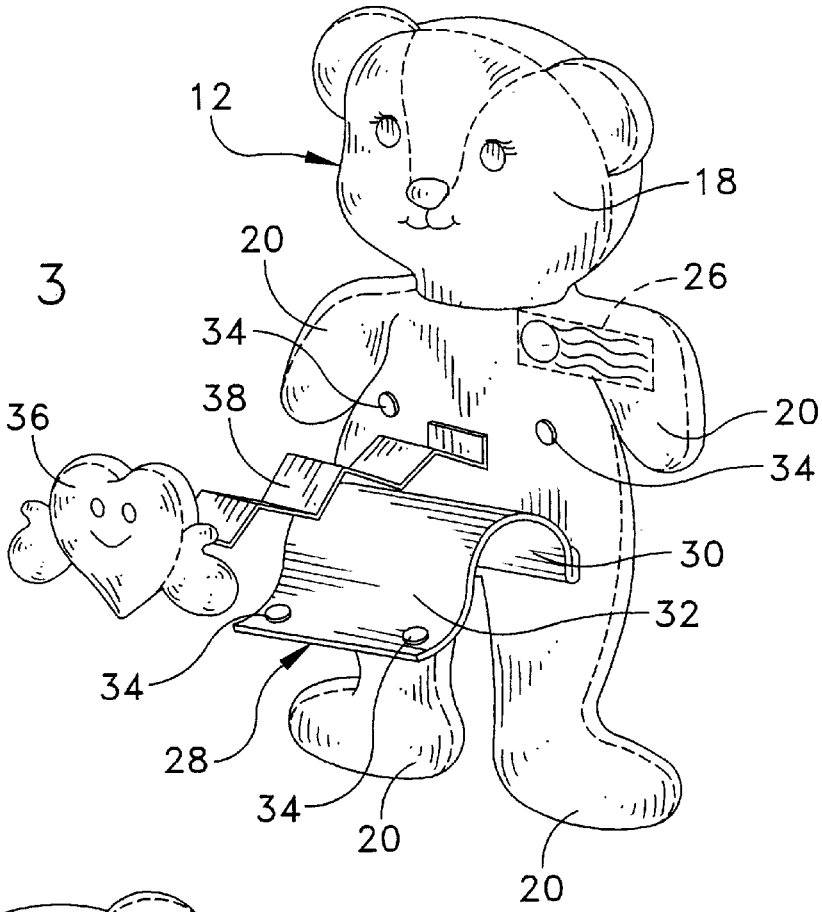
FIG. 3 is a perspective view of the toy bear with the front flap opened to reveal a hidden toy.
Figure 4:
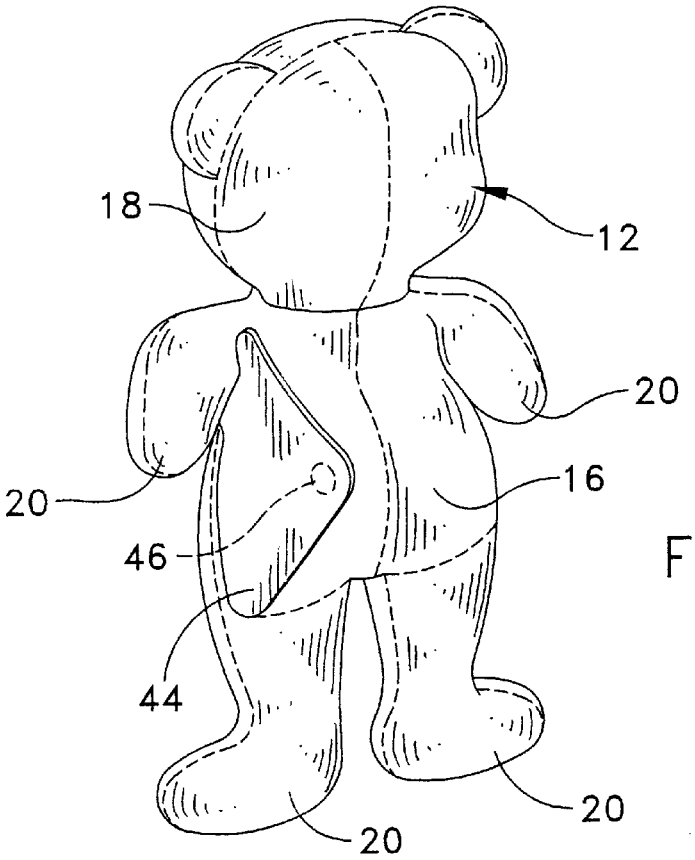
FIG. 4 is a perspective rear view of the toy bear showing a pocket.
Figure 5:
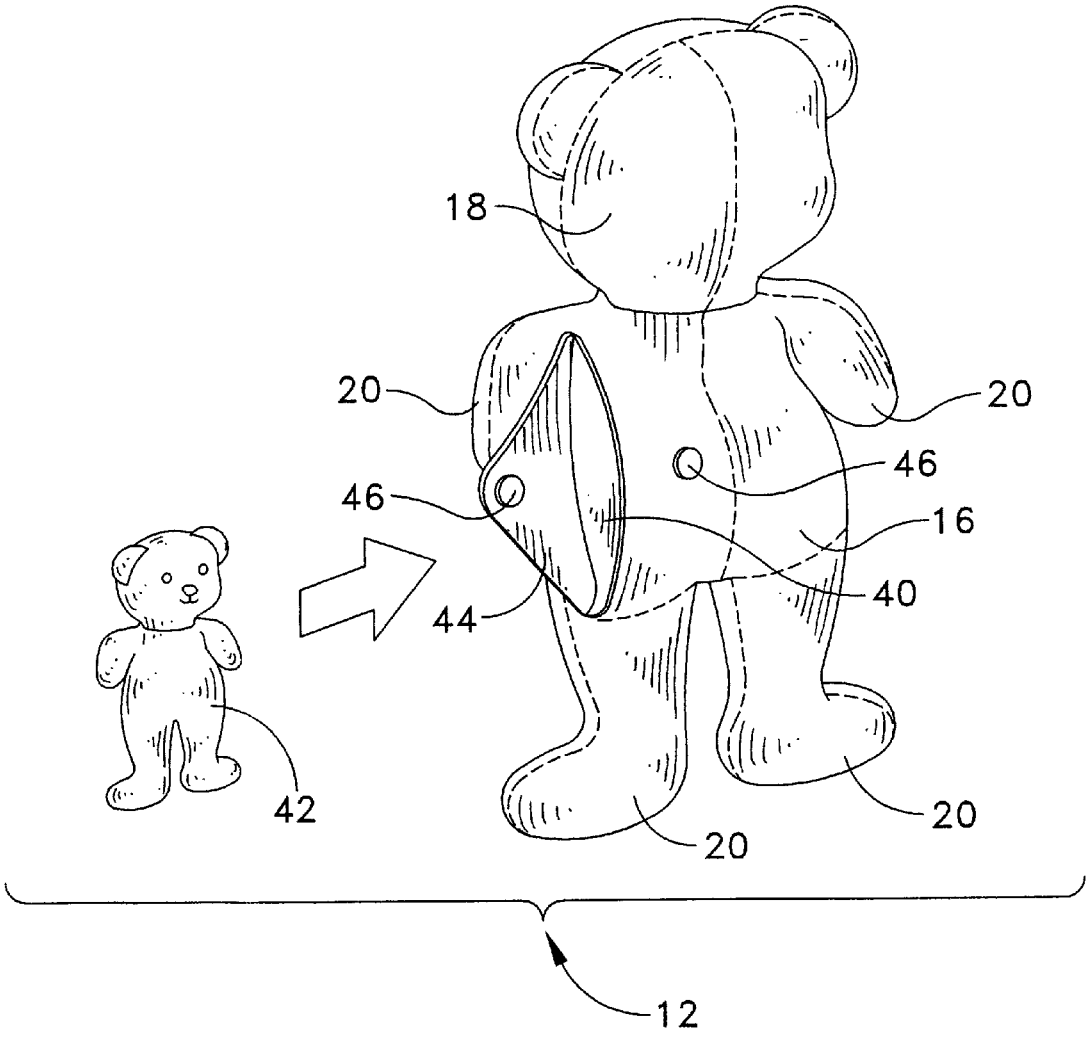
FIG. 5 is another view thereof with the pocket flap open and showing the insertion of a miniature gift bear into the pocket.

Referring now to FIGS. 3–9, the toy 12 can be further provided with additional features including: areas to write personal messages or draw pictures; pockets for receiving gift items; flaps for hiding pictures, gift items and additional writing areas; electronic voice chips for outputting and/or recording voice or musical greetings; strings for hanging the toy as an ornament; pins for attaching the toy to clothing; and other features common to greeting items. More specifically, in FIG. 3, the toy 12 is provided with a flap generally indicated at 28 on the front of the body portion 16. One end 30 of the flap 28 is attached to the body portion 16 of the toy 12 by stitching or other appropriate means, while the second end 32 is movable between open and closed positions. The second end 32 of the flap 28 and the body portion 16 of the bear 12 include mating patches 34 of hook and pile fastener materials which are intended to releasably maintain the flap 28 in a closed condition during mailing and storage. The address areas 22, 24 are preferably located on the front surface of the flap 28. As illustrated in FIG. 3, a gift item, or toy 36 can be located behind the flap 28 to provide additional play value to the toy 12. In the illustrated embodiment, the hidden toy item 36 is attached to the toy 12 with an accordion strip 38. The gift item 36 would obviously be hidden from the recipient until the toy 12 was removed from the casing 14 and the flap 28 opened to reveal the item 36. Referring to FIGS. 4 and 5, the toy 12 is also provided with a side pocket 40 in which another gift item, such as a miniature plush bear 42, may be received. The pocket 40 includes a triangular flap 44 which extends outwardly from the front edge of the pocket 40, and wraps around the back of the toy 12 to cover the opening of the pocket. The apex of the triangular flap 44 is releasably secured to the back surface of the bear 12 by hook and pile materials 46 attached in mating locations.

Figure 6:
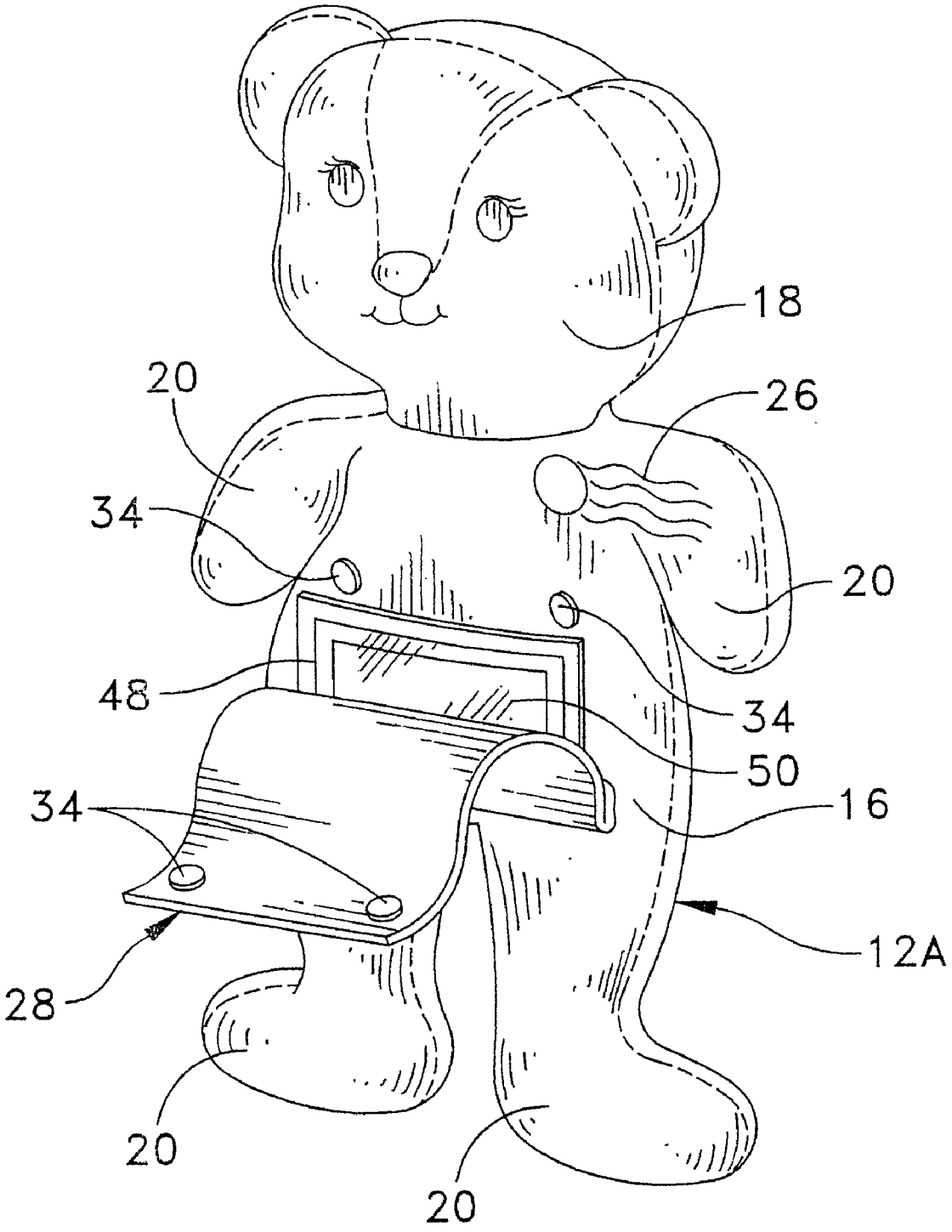
FIG. 6 is a perspective view of a toy bear incorporating a transparent pocket beneath the flap.

Referring to FIG. 6, an alternative toy bear is illustrated and generally indicated at 12A. The toy bear 12A includes a transparent pocket 48 located behind the flap 28. The pocket 48 preferably comprises a square sheet of transparent plastic attached around three edges thereof to the body portion of the bear by stitching or other suitable attachment means. The address areas 22, 24 are still located on the front surface of the flap 28. The transparent pocket 48 can receive a photograph 50 for the recipient which would be hidden until the recipient opened the flap. The pocket 48 could also receive other gift items.

Figure 7:
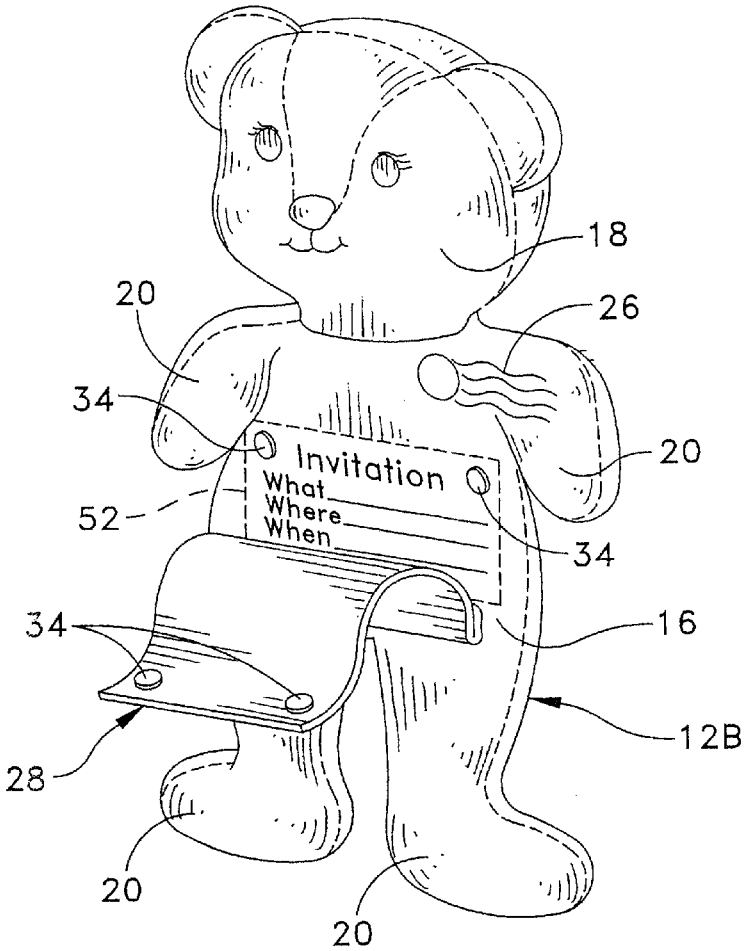
FIG. 7 is a perspective view of a toy invitation bear having a predetermined writing area beneath the flap for writing the time, date and location of an event.

Turning to FIG. 7, a mailable invitation bear is illustrated and generally indicated at 12B. The bear 12B is converted to an invitation simply by providing a space behind the flap 28 with an additional writing area 52 for receiving information regarding a party or other event. The address areas 22, 24 are still located on the front of the flap 28 such that the information regarding the party or event, is kept hidden until the toy 12 is removed from the casing 14, and the flap 28 opened.

Figure 8:
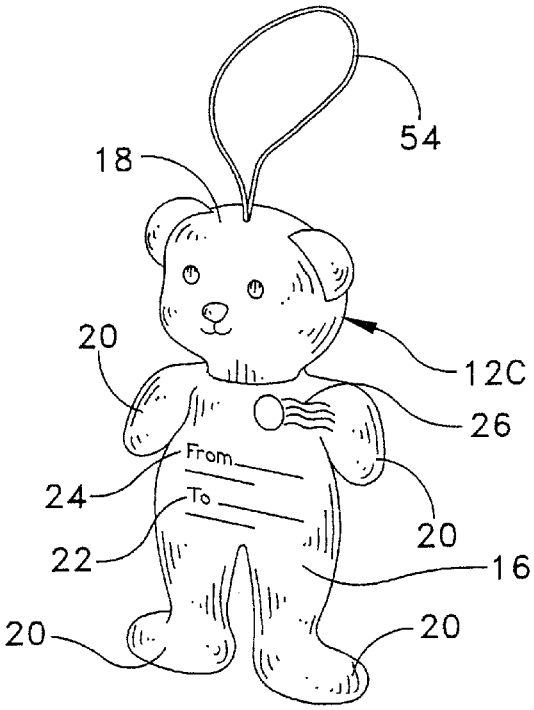
FIG. 8 is a perspective view of a toy ornament bear having a string for hanging the toy bear as a decorative ornament and a predetermined writing area for receiving a written message.

Turning to FIG. 8, a mailable ornament bear is illustrated and generally indicated at 12C. The bear 12C functions as an ornament by providing the toy 12 with a string 54, or other means, for hanging the toy 12 as a decorative ornament. This type of embodiment would typically be smaller than the above-noted embodiments, and may or may not include a flap 28 as previously described. The illustrated embodiment does not include a flap, although this should not be construed to limit this embodiment in any way.

Figure 9:
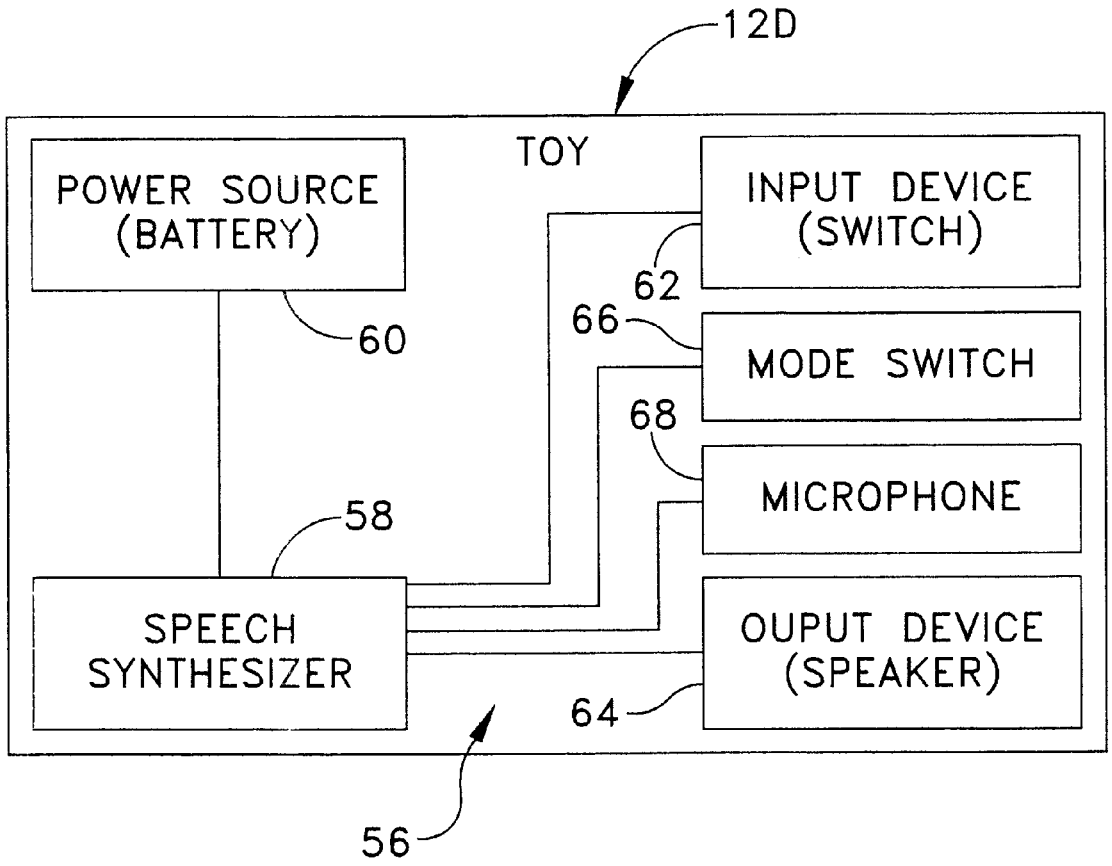
FIG. 9 is a schematic view of an electronic toy which is capable of selectively producing an electronic audio greeting.
Figure 10:
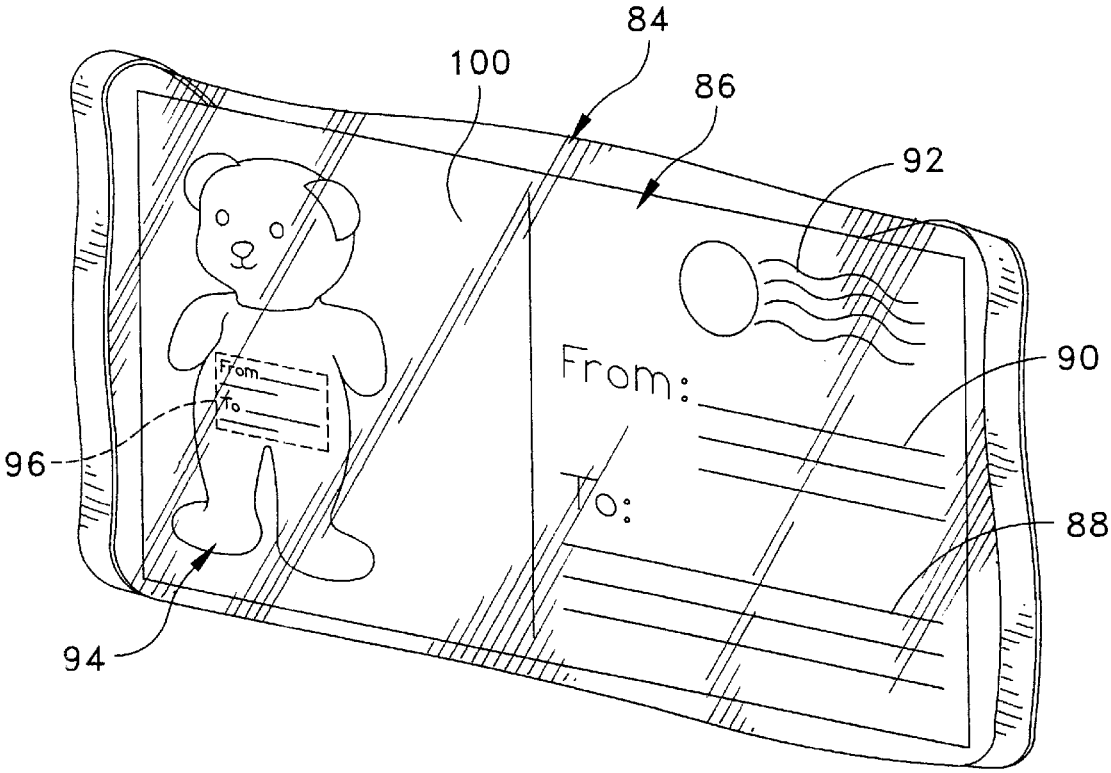
FIG. 10 is a perspective view of another embodiment of the toy and packaging assembly.
Figure 11:
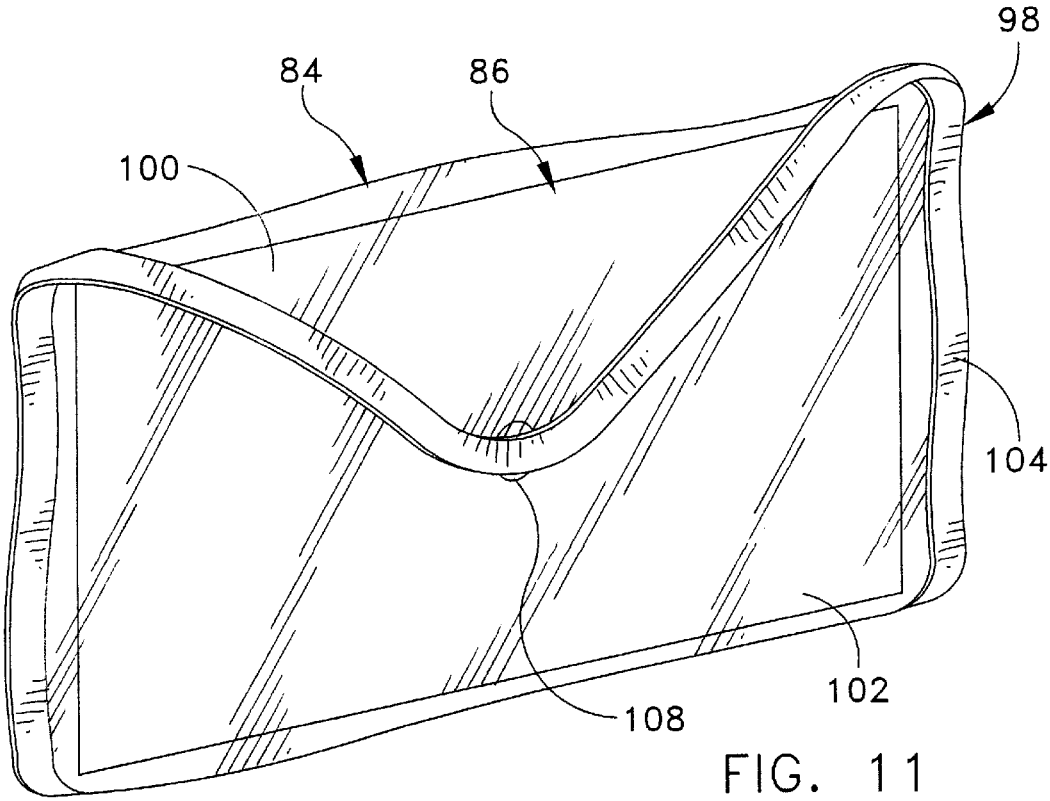
FIG. 11 is a rear perspective view thereof.
Figure 12:
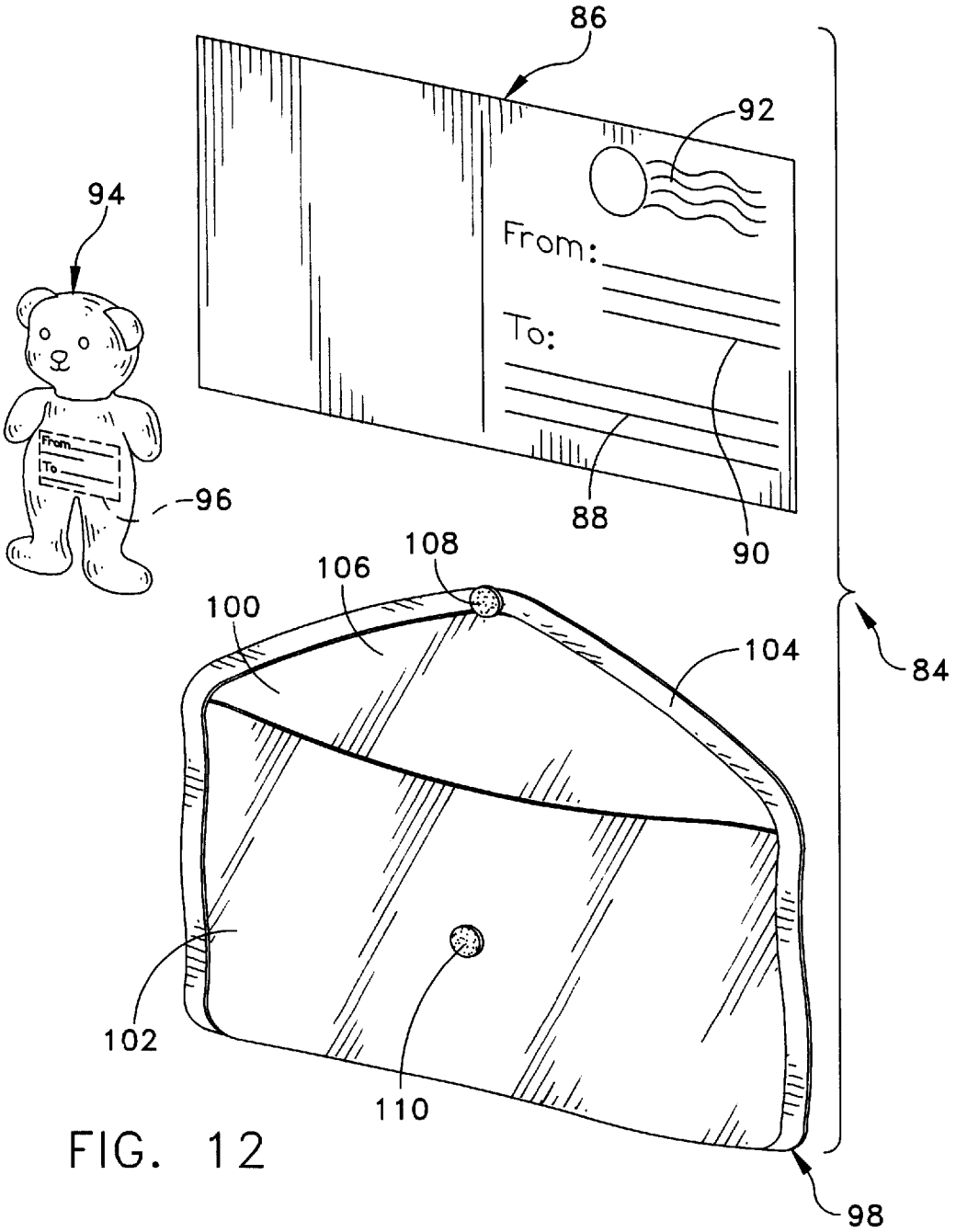
FIG. 12 is an exploded perspective view thereof.
Figure 13:
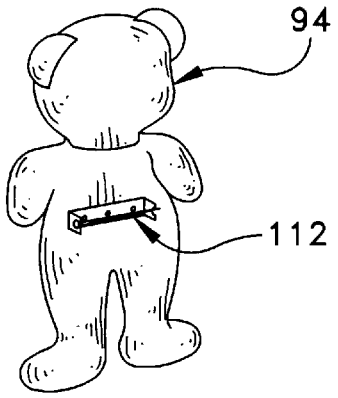
FIG. 13 is a rear perspective view of the miniature toy bear.

It is also contemplated that the toy 12 could be provided with electronics which would allow the toy 12 to output an audio greeting such as music, or a spoken message. Such electronic circuitry is conventional in the electronic arts, and therefore only a general schematic of such a circuit will be discussed. Referring to FIG. 9, a toy incorporating such an electronic circuit is illustrated schematically and generally indicated at 12D. The toy 12D preferably comprises a conventional plush toy wherein an electronic circuit generally indicated at 56 is hidden within the interior of the body of the toy. Such an electronic circuit 56 typically comprises a speech synthesizer chip 58, a power source 60, such as a battery, an input device 62 such as a contact switch, and an output device 64, such as a speaker. Speech synthesizer chips 58 of the type contemplated for use herein are well known in the electronics art, and will not be described further. Such speech chips 58 are well known for their ability to store musical greetings and/or prerecorded messages which are output through the speaker 64 upon actuation of a contact switch 62 located somewhere within the toy 12D. The switch 62 would likely be located within a hand portion of the toy plush animal 12D such that squeezing of the hand would close the contact switch 62. In addition, speech synthesizer chips 58 are also well known for their ability to record personal messages and to then replay the recorded message. In this regard, the toy 12D would further include a mode switch 66 to switch from a playback mode to record mode, and a miniature microphone 68 to provide audio input to the speech synthesizer chip 58.

In use, the plush toy animal 12 is received within the transparent, flexible plastic casing which must be sufficiently durable to be sent through a postal system, 14 for mailing. The casing 14 preferably comprises front and rear facing sheets 70, 72 respectively, of a flexible transparent plastic which are secured together around their peripheral edges, preferably by stitching, or alternatively by other plastic joining methods. The edges of the casing 14 further preferably includes a fabric piping material 74 stitched together with the edges to cover edges of the plastic sheets 70, 72. The casing 14 preferably has a shape which conforms to the outer surface of the toy 12 and includes a resealable opening generally indicated 76 for inserting and removing the toy 12 from the casing 14. The opening 76 is formed by unstitched portions of the bottom edges of the front and rear sheets 70, 72. The unstitched edge portions are provided with means for releasably sealing the opening 76 for mailing. The preferred means of sealing the opening comprises mating strips of hook and pile fastening materials 78, 80, although other sealing means are also suitable. Referring back to FIGS. 1 and 2, when the toy 12 is received within the casing 14, the mailing and return addresses 22, 24 are clearly visible through the transparent casing 14 in the same general positions as they would be located on an envelope so that the assembly 10 can be properly handled by mail carriers. A postage stamp 82 bearing the appropriate postage is placed on the exterior of the casing 14 (See FIG. 2) over the predetermined area 26 indicated on the body portion 16 of the toy 12, after which, the entire toy assembly 10 can be placed into the mail without additional packaging.

Turning now to FIGS. 10–13, another embodiment of the concept is illustrated and generally indicated at 84 comprising: a card or, mailing label generally indicated at 86 having areas 88, 90 respectively, upon which the sender can write the mailing and return addresses, and an area 92 for designating proper placement of postage; a miniature toy generally indicated at 94, preferably a miniature plush toy animal, having at least one predetermined area 96 (shown in broken lines) upon which a personal greeting and/or the names of the sender and receiver can be written; and a transparent, flexible plastic envelope generally indicated at 98. The plastic envelope 98 is formed much like the previously described plastic casing 14, being constructed from front and rear sheets 100, 102 of flexible plastic material which are stitched together around the peripheral edges with a piping material 104, and including an opening for inserting and removing the toy 94. The only difference being that the envelope 98 is obviously constructed in the shape of a conventional envelope, including a triangular flap 106 on the front sheet 100 for sealing the opening of the envelope. The flap 106 is releasably secured to the back sheet 102 of the envelope by mating patches 108, 110 of hook and pile materials. The card 86 and toy 94 are received within the envelope 98 for mailing. Where the toy 94 comprises a miniature plush toy, such as illustrated in the drawing figures, the toy 94 also preferably includes a pin 112 for the receiver to attach the toy 94 to clothing. Alternatively, the toy may include a string (not shown) for hanging the toy 94 as an ornament, or can further include any of the other optional features as described herein above.

Figure 14:
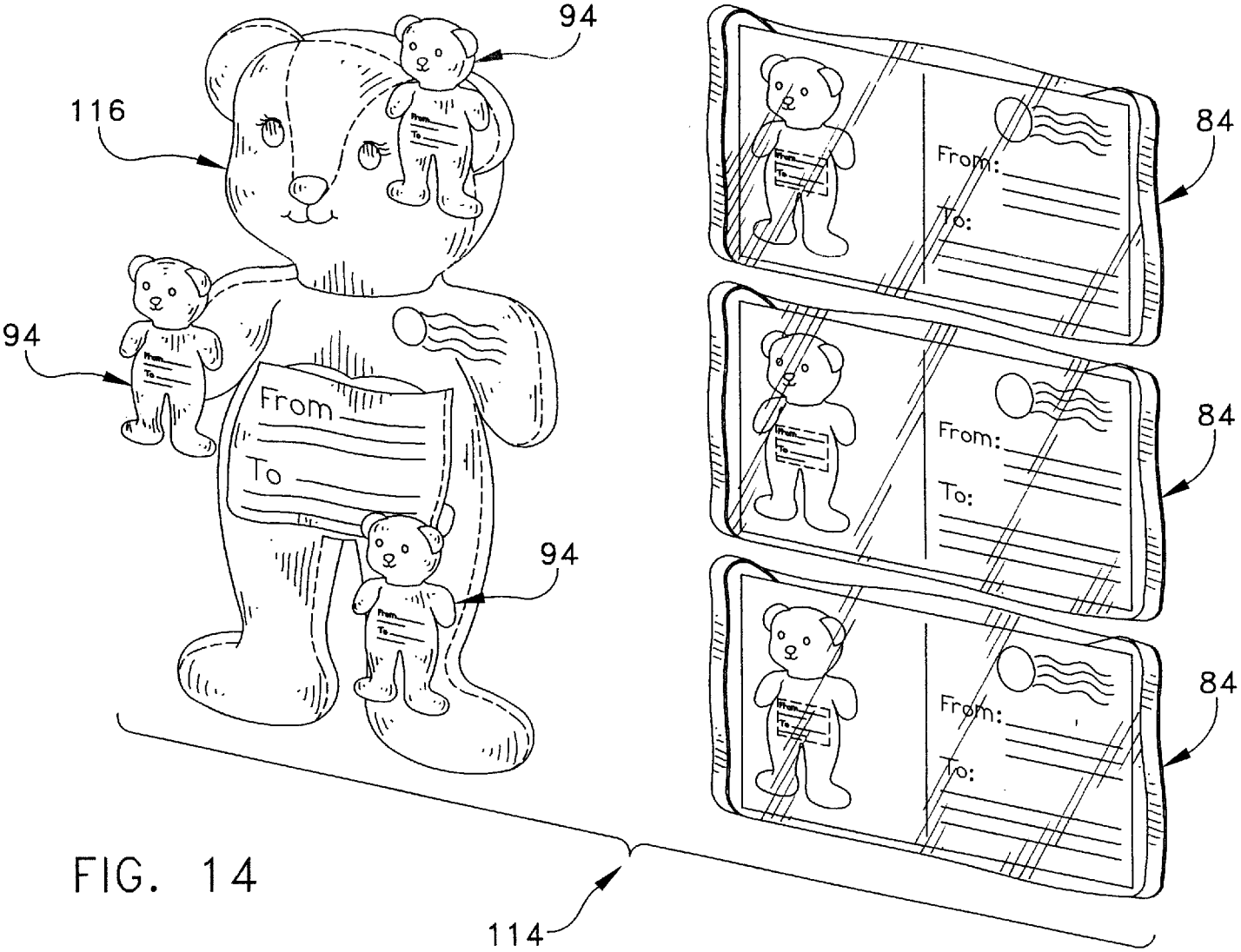
FIG. 14 is a perspective view of yet another embodiment of the toy and packaging assembly.

In yet another concept as illustrated in FIG. 14, a toy assembly generally indicated at 114 comprises a larger primary toy generally indicated at 116, preferably a plush toy, and a plurality of mailable toy assemblies 84 as described above, each including a card 86, a miniature toy 94, and a transparent flexible plastic envelope 98. In use, the assembly 114 is sold together as a unit wherein the larger primary toy 116 is retained by the buyer. The buyer would thereafter send the envelope toy assemblies 84 to his/her friends, while the friends would also do the same, the object being to exchange and collect a plurality of the miniature toys 94, each bearing a personal message, and to attach them to the larger primary plush animal 116.

It can therefore be seen that the instant invention provides a plurality of unique and amusing toy assemblies which are believed to have significant play value. The provision of a toy which includes pre-designated areas for receiving mailing and return addresses, and for indicating placement of postage is believed to be unique in the art. The further combination of the toy with a flexible, transparent casing for enclosing the toy so that the toy can be placed in the mail without further packaging is also believed to be unique in the art. The transparent casing allows the written addresses to be clearly visible through the casing so that the toy can be properly handled through the mail system. The variety of different optional greeting features which can be incorporated with the toy provides further value to the invention in that the toy can function as a gift, and invitation, an ornament, a pin, etc. Still further, the alternative embodiments of the toy including multiple assemblies which are suitable mailing provides substantial commercial value to the toy. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy assembly which is suitable for mailing by a user comprising:

a plush toy character figure having a soft fabric outer surface including at least one predetermined area thereon which bears indicia designating it as a mailing address area and which is constructed and arranged to receive a mailing address provided thereon by the user, the mailing address including the name and address of an intended receiving party; and a flexible, transparent outer casing constructed and arranged to receive the plush toy character figure therein and including an outer surface constructed and arranged to receive postage, and further including a sealable opening for inserting and removing the toy character figure from the casing;

wherein upon placing the mailing address of the receiving party in the first predetermined area and positioning the toy character figure within the outer casing and sealing the same, the mailing address is clearly visible through the casing in the same general position as it would be located on an envelope, so that the toy assembly can be placed directly into a mail system for delivery upon placing postage on the casing without further packaging, and can also be readily handled by a mail carrier.

2. The toy assembly of claim 1, wherein the at least one predetermined area includes a second predetermined area which bears indicia designating it as a return address area and which is constructed and arranged to receive the return address provided thereon by the user.

3. The toy assembly of claim 2, wherein the at least one predetermined area includes a third predetermined area which bears indicia designating it as a postage area and which is constructed and arranged to indicate proper placement of postage on the outer casing when the toy assembly is disposed therein.

4. The toy assembly of claim 1, said casing having a shape which substantially conforms to the outer surface of the toy character figure.

5. The toy assembly of claim 1, wherein the plush toy character figure includes an interior cavity.

6. The toy assembly of claim 1, wherein the outer surface of the toy character figure includes a flap which is movable between a closed position and an open position.

7. The toy assembly of claim 6, wherein said first predetermined area is located on an outer surface of the flap such that the first predetermined area is visible through the outer casing when the toy is disposed therein and the flap is in the closed position.

8. The toy assembly of claim 6, further comprising a transparent pocket positioned on the outer surface of the toy character figure and substantially covered by the flap when the flap is in the closed position.

9. The toy assembly of claim 6, wherein the at least one predetermined area includes a fourth predetermined area located on the outer surface of the toy character figure and substantially covered by the flap when the flap is in the closed position, the fourth discrete predetermined area being constructed and arranged to receive additional information thereon.

10. The toy assembly of claim 1, further comprising means for selectively outputting an audio greeting.

11. A toy assembly which is suitable for mailing comprising:

a plush toy character figure having a soft fabric outer surface, said outer surface having first, second and third discrete predetermined areas thereon which bear indicia designating them as mailing address, return address and postage areas, respectively, and which are constructed and arranged to receive a mailing address, a return address, and to indicate proper placement of postage, respectively; and a flexible, transparent outer casing constructed and arranged to receive the plush toy character figure therein and including a sealable opening for inserting and removing the toy character figure from the casing;

wherein upon placing the mailing address of a receiving party in the first predetermined mailing address area and positioning the toy character figure within the outer casing and sealing the same, the mailing address is clearly visible through the casing in the same general position as it would be located on an envelope, so that the toy assembly can be placed directly into a mail system for delivery without further packaging, and can also be readily handled by a mail carrier.

12. In the toy assembly of claim 11, said plush toy further comprising an opaque flap on the outer surface, said flap being hingably movable between a closed position and an open position, and means for selectively maintaining said flap in the closed position.

13. The toy assembly of claim 11 further comprising a postage stamp on the outer surface of said casing in substantial alignment with said third predetermined area.

14. The toy assembly of claim 11, said casing having a shape which substantially conforms to the outer surface of the toy character figure.

15. The toy assembly of claim 11, wherein the plush toy character figure includes an interior cavity.

16. The toy assembly of claim 11, wherein the outer surface of the toy character figure includes a flap which is movable between a closed position and an open position.

17. The toy assembly of claim 16, wherein said first predetermined area is located on an outer surface of the flap such that the first predetermined area is visible through the outer casing when the toy is disposed therein and the flap is in the closed position.

18. The toy assembly of claim 16, further comprising a transparent pocket positioned on the outer surface of the toy character figure and substantially covered by the flap when the flap is in the closed position.

19. The toy assembly of claim 16, further comprising a fourth discrete predetermined area located on the outer surface of the toy character figure and substantially covered by the flap when the flap is in the closed position, the fourth discrete predetermined area being constructed and arranged to receive additional information thereon.

20. The toy assembly of claim 16, wherein the plush toy character figure includes an interior cavity.

21. The toy assembly of claim 11, further comprising means for selectively outputting an audio greeting.

* * * * *